US007616177B2

(12) United States Patent
Peng et al.

(10) Patent No.: US 7,616,177 B2
(45) Date of Patent: Nov. 10, 2009

(54) PIXEL DRIVING CIRCUIT WITH THRESHOLD VOLTAGE COMPENSATION

(75) Inventors: Du-Zen Peng, Chubei (TW); Shih-Feng Huang, Taichung (TW)

(73) Assignee: TPO Displays Corp., Chu-Nan (TW)

( * ) Notice: Subject to any disclaimer, the term of this patent is extended or adjusted under 35 U.S.C. 154(b) by 687 days.

(21) Appl. No.: 11/173,820

(22) Filed: Jul. 1, 2005

(65) Prior Publication Data

US 2006/0023551 A1 Feb. 2, 2006

Related U.S. Application Data

(60) Provisional application No. 60/598,168, filed on Aug. 2, 2004, provisional application No. 60/634,401, filed on Dec. 7, 2004.

(51) Int. Cl.
*G09G 3/30* (2006.01)

(52) U.S. Cl. ..... 345/76; 345/77; 345/78; 345/79; 345/80; 345/81; 345/83

(58) Field of Classification Search ..... 345/76–83
See application file for complete search history.

(56) References Cited

U.S. PATENT DOCUMENTS

| | | | | |
|---|---|---|---|---|
| 6,229,506 | B1 | 5/2001 | Dawson et al. | |
| 7,173,585 | B2 * | 2/2007 | Weng | 345/82 |
| 2003/0034939 | A1 * | 2/2003 | Moon | 345/76 |
| 2003/0107565 | A1 * | 6/2003 | Libsch et al. | 345/211 |
| 2004/0070557 | A1 * | 4/2004 | Asano et al. | 345/76 |

FOREIGN PATENT DOCUMENTS

| | | |
|---|---|---|
| EP | 1441325 | 7/2004 |
| JP | 2002-169510 | 6/2002 |
| JP | 2002-341790 | 11/2002 |
| JP | 2003-122301 | 4/2003 |
| JP | 2003-173165 | 6/2003 |

OTHER PUBLICATIONS

Komiya, N., "A 2.0-in. AMOLED Panel w/ Voltage Programming Pixel Circuits & Point Scanning Data Driver Circuits", IDW, 2004, pp. 283-286, AMD3/0LED5-3.

(Continued)

*Primary Examiner*—Alexander Eisen
*Assistant Examiner*—Stuart McCommas
(74) *Attorney, Agent, or Firm*—Liu & Liu

(57) ABSTRACT

A pixel driving circuit with threshold voltage and EL power compensation. The pixel circuit includes a storage capacitor, a transferring circuit, a driving element, and a switching circuit. The transferring circuit transfers a data signal or a variable reference signal to a first node of the storage capacitor. The driving element has a first terminal coupled to a first fixed potential and a second terminal coupled to a second node of the storage capacitor. The switching circuit is coupled to a third terminal of the driving element and the second node of the storage capacitor. The switching circuit can be controlled to make the driving element diode-connected in one time period and allowing a driving current to be output to a display element in another time period.

30 Claims, 13 Drawing Sheets

OTHER PUBLICATIONS

Komiya, N., "Comparison of Vth Compensation Ability Among Voltage Programming Circuits for AMOLED Panels", IDW, 2003, pp. 275-278, AMD4/OEL5-3.

Fish, D., 32.1: Invited Paper: "A Comparison of Pixel Circuits for Active Matrix Polymer/Organic LED Displays", SID, 2002 Digest, pp. 968-971.

Dawson, R.M.A., 4.2: "Design of An Improved Pixel For a Polysilicon Active-Matrix Organic LED Display", SID, 1998.

Choi, Sang-Moo, P-11: "An Improved Voltage Programmed Pixel Structure For Large Size & High Resolution AM-OLED Displays", SID 2004 Digest, pp. 260-263.

* cited by examiner

200

200

PIXEL DRIVING CIRCUIT WITH THRESHOLD VOLTAGE COMPENSATION

BACKGROUND

The present invention relates to a circuit in a panel display and, in particular, to a pixel driving circuit with threshold voltage and electroluminescent(EL) power compensation.

Active matrix organic light emitting diode (AMOLED) displays are currently emerging next generation of flat panel displays. As compared with an active matrix liquid crystal display (AMLCD), an AMOLED display has many advantages, such as higher contrast ratio, wider viewing angle, thinner module without backlight, low power consumption as well as low cost. Unlike an AMLCD display, which is driven by a voltage source, an AMOLED display requires a current source to drive an EL device. The brightness of the EL device is proportional to the current conducted thereby. Variations of current level have great impact on brightness uniformity of an AMOLED display. Thus, the quality of a pixel driving circuit is critical to display quality.

FIG. 1 illustrates a conventional 2T1C(2 transistors and 1 capacitor) circuit for each pixel in an AMOLED display. When a signal SCAN turns on a transistor M1, data shown as $V_{data}$ in the figure is loaded into a gate of a p-type transistor M2 and stored in the capacitor Cst. Thus, there will be a constant current driving the EL device to emit light. Typically, in an AMOLED, a current source is implemented by a P-type TFT(M2 in FIG. 1) gated by a data voltage $V_{data}$ and having source and drain connected to $V_{dd}$ and the anode of the electroluminescent(EL) device, respectively, as shown in FIG. 1. The brightness of the EL device with respect to $V_{data}$ therefore has the following relation.

Brightness $\propto$ current $\propto (V_{dd}-V_{data}-V_{th})^2$ where $V_{th}$ is a threshold voltage of M2 and $V_{dd}$ is a power supply voltage.

Since there is typically a variation of $V_{th}$ for LTPS type TFT due to a low temperature polysilicon (LTPS) process, it is supposed that a non-uniformity problem in brightness exists in AMOLED display if $V_{th}$ is not properly compensated. Moreover, a voltage drop on the power line also causes the brightness non-uniformity problem. To overcome such problems, implementation of a pixel driving circuit with $V_{th}$ and $V_{dd}$ compensation to improve display uniformity is desired.

SUMMARY

Embodiments of the present invention disclose a pixel driving circuit with threshold voltage and EL power compensation. Variations of input voltage affecting pixel current, arising from variations such as in switch threshold voltage, power supply voltage or both, are compensated and the driving current is less affected by, and depending on the circuit design could be independent of $V_{th}$ ($V_{dd}$). Thus, the brightness of each pixel is independent of $V_{th}$ ($V_{dd}$).

A pixel driving circuit with threshold voltage compensation according to some embodiments of the present invention comprises a storage capacitor, a transferring circuit, a driving transistor, and a switching circuit. The transferring circuit transfers a data signal or a variable reference signal to the first node of the storage capacitor. The driving transistor has a first terminal coupled to a first fixed potential and a second terminal coupled to the second node of the storage capacitor. The switching circuit is coupled to a third terminal of the driving transistor and the second node of the storage capacitor. The switching circuit can be controlled to make the driving transistor diode connected.

A method for driving a display device according to one embodiment of the present invention comprises loading a data signal, a threshold voltage of a first transistor and a fixed potential into the storage capacitor. The loaded data signal, the loaded threshold voltage of the first transistor and the loaded fixed potential are coupled to the first transistor to provide a driving current independent of threshold or fixed potential to the display device.

DETAILED DESCRIPTION

Figure 1:
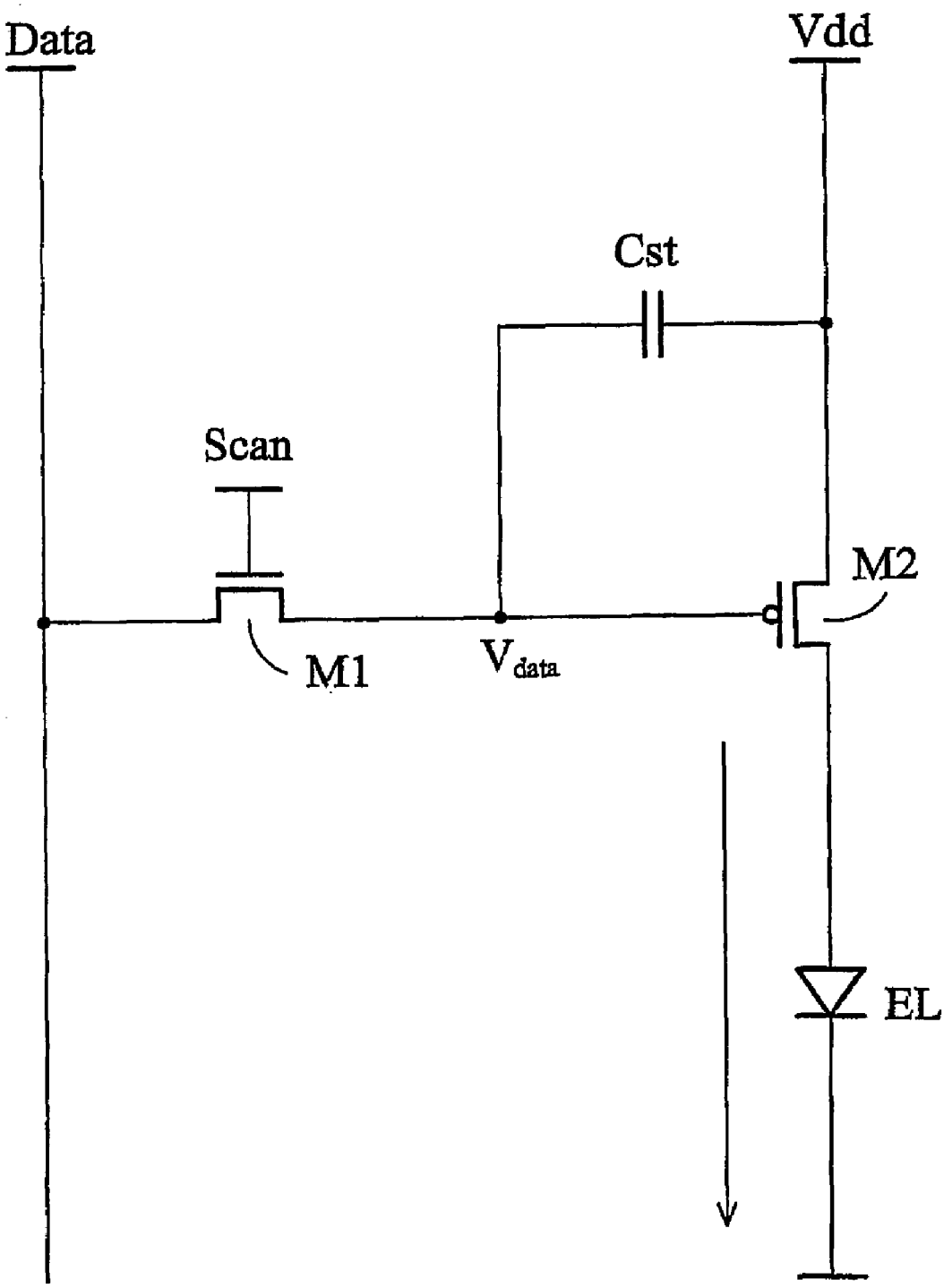
FIG. 1 is a circuit diagram illustrating the structure of a conventional 2T1C (2 transistors and 1 capacitor) circuit for each pixel in an AMOLED display.
Figure 2:
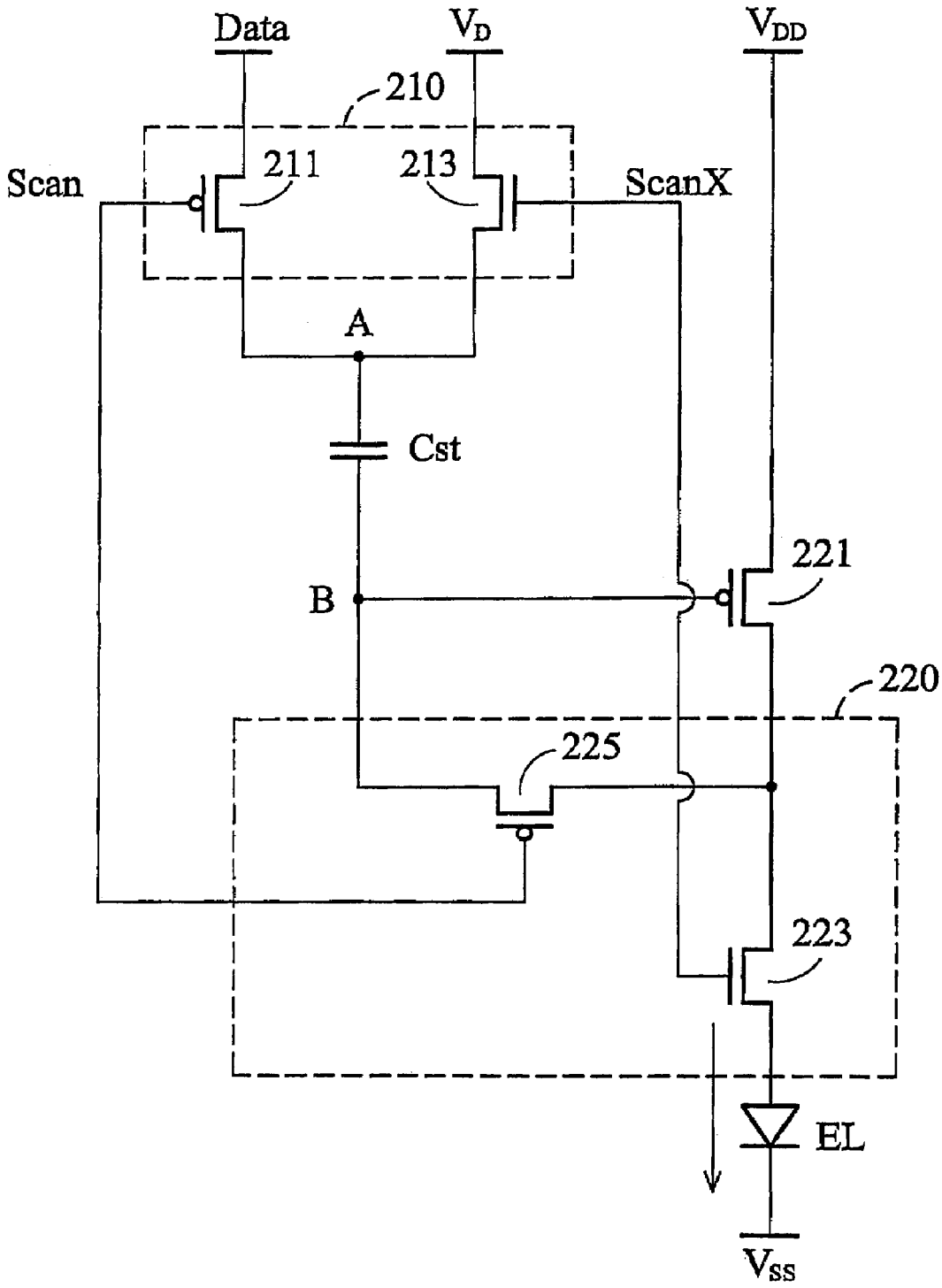
FIG. 2 is a circuit diagram showing the structure of a pixel driving circuit according to one embodiment of the present invention.

FIG. 2. is a circuit diagram showing a structure of a pixel driving circuit having threshold voltage and power compensation according to a first embodiment of the present invention. The pixel driving circuit 200 comprises a storage capacitor Cst, a transferring circuit 210, a driving transistor 221, and a switching circuit 220. The transferring circuit 210 is coupled to a first node A of the storage capacitor Cst and transfers a data signal Data or a variable reference signal $V_D$ thereto. The variable reference signal VD can be a pulse reference signal. The driving transistor 221 is a PMOS transistor and has a first terminal (source) coupled to a first fixed potential and a second terminal (gate) coupled to a second node B of the storage capacitor. More specifically, the first fixed potential is a power supply potential $V_{DD}$. The switching circuit 220 is coupled to a third terminal (drain) of the driving transistor 221 and the second node B of the storage capacitor. The switching circuit 220 can be controlled to make the driving transistor 221 diode connected. A display device EL is coupled to the switching circuit 220. Preferably, the display device EL can be an electroluminescent device.

Additionally, a cathode of the display device EL is coupled to a second fixed potential. More specifically, the second fixed potential is a ground potential $V_{SS}$.

A transferring circuit 210 according to this embodiment of the present invention comprises a first transistor 211 and a second transistor 213, as shown in FIG. 2. In FIG. 2, the first and second transistors are a PMOS and a NMOS transistor respectively. A first terminal (source) of the first transistor 211 receives the data signal Data. A second terminal (gate) and a third terminal (drain) of the first transistor 211 are connected to a first scan line Scan and the first node A of the storage capacitor Cst, respectively. A first terminal (drain) of the second transistor 213 receives a variable reference signal $V_D$. A second terminal (gate) and a third terminal (source) of the second transistor 213 are connected to a second scan line ScanX and the first node A of the storage capacitor Cst, respectively. More specifically, the first transistor 211 and the second transistor 213 are thin film transistors. Preferably, the thin film transistors are polysilicon thin film transistors, providing higher current driving capability. When a first scan line Scan is pulled low, the transferring circuit 210 transfers a data signal Data to the first node A of the storage capacitor Cst. When a second scan line ScanX is pulled high, the transferring circuit 210 transfers the variable reference signal $V_D$ to the first node A of the storage capacitor Cst.

A switching circuit 220 according to the embodiment of the present invention comprises a third transistor 223 and a fourth transistor 225, as shown in FIG. 2. As shown in FIG. 2, the third and fourth transistors are a NMOS and a PMOS transistor respectively. A first (source) terminal of the third transistor 223 is connected to the anode of the display device EL, while a second (gate) and a third (drain) terminal of the third transistor 223 are connected to the second scan line ScanX and a third (drain) terminal of the driving transistor 221, respectively. A first (drain) terminal of the fourth transistor 225 is coupled to the third (drain) terminals of the driving transistor 221 and the third transistor 223. A second (source) terminal of the fourth transistor 225 is coupled to the second node B of the storage capacitor Cst and the second (gate) terminal of the driving transistor 221. A third (gate) terminal of the fourth transistor 225 is connected to the first scan line Scan. More specifically, the third transistor 223 and the fourth transistor 225 are thin film transistors. Preferably, the thin film transistors are polysilicon thin film transistors, providing higher current driving capability. When the first scan line is pulled low, the fourth transistor 225 in the switching circuit makes the driving transistor 221 as a diode-connected transistor.

Figure 3:
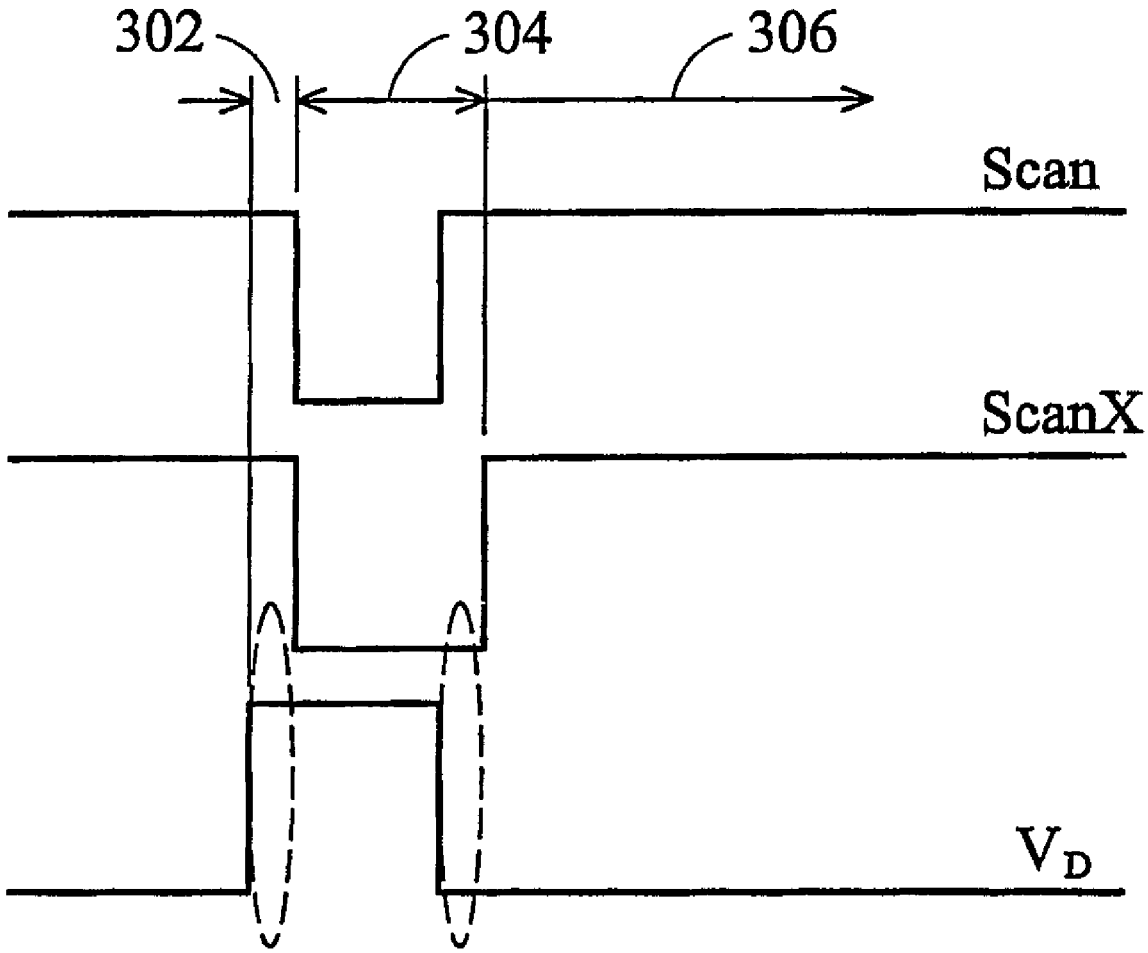
FIG. 3 is a timing diagram illustrating the timing of a scan signal in the scan line Scan and a reference signal $V_D$ for the pixel driving circuit shown in FIG. 2.

FIG. 3 illustrates a timing diagram of signals of the first and second scan lines Scan, ScanX and a variable reference signal $V_D$ for the pixel driving circuit 200 shown in FIG. 2. From a previous emission mode of the pixel driving circuit, when the signal $V_D$ is pulled high and the signals Scan and ScanX are kept high, the pixel driving circuit 200 in FIG. 2 is operated in a discharge mode 302. In this discharge mode, a high-level reference signal $V_D$ is inputted to the node A of the storage capacitor Cst and thus turn on the transistors 223 and 225. The charge stored in the storage capacitor Cst is thus discharged in this discharge mode 302. The discharge of the storage capacitor Cst ensures the normal operation of a diode-connected driving transistor 221 and the fourth transistor 225 in subsequent steps.

Following the discharge of the storage capacitor Cst, the scan lines Scan and ScanX are pulled low, and then the pixel driving circuit 200 enters a scan mode 304. When the first and the second scan lines Scan and ScanX are pulled low, the transistors 211 and 225 are turned on while the transistors 213 and 223 are turned off. Since the transistors 211 and 225 are turned on, a voltage $V_A$ at the first node A of the storage capacitor Cst equals a voltage $V_{data}$ of the data signal Data and a voltage $V_B$ at the second node B of the storage capacitor Cst equals a voltage of $V_{dd}-V_{th}$, where $V_{th}$ is the threshold voltage of the driving transistor 221. Thus, the stored voltage across the storage capacitor is $V_A-V_B=V_{data}-V_{dd}+V_{th}$.

When the first scan line Scan and the second scan line ScanX are pulled high, the scan mode 304 ends and the pixel driving circuit 200 enters an emission mode 306. Additionally, at substantially the end of the scan mode 304, the reference signal $V_D$ is pulled low. Since the first scan line Scan is kept high and the second scan line ScanX is also pulled high, the transistors 211 and 225 are turned off while the transistors 213 and 223 are turned on. Since $V_D$ is pulled to 0V and the transistor 213 is turned on, the voltage $V_A$ at the first node A of the storage capacitor Cst is also pulled to 0V. The voltage across the storage capacitor cannot be changed immediately and the voltage $V_B$ at the second node B of the storage capacitor Cst becomes $V_{dd}-V_{data}-V_{th}$. The electrical current flowing through the display device is proportional to $(V_{sg}-V_{th})^2$ and is therefore proportional to $V_{data}^2$. Thus, the current flowing through the display device is independent of the threshold voltage $V_{th}$ of the driving transistor 221 as well as $V_{dd}$, the driving power supply potential of the driving transistor 221. The afore-described operation repeats as the pixel driving circuit controls the emissions of the pixel.

Figure 4:
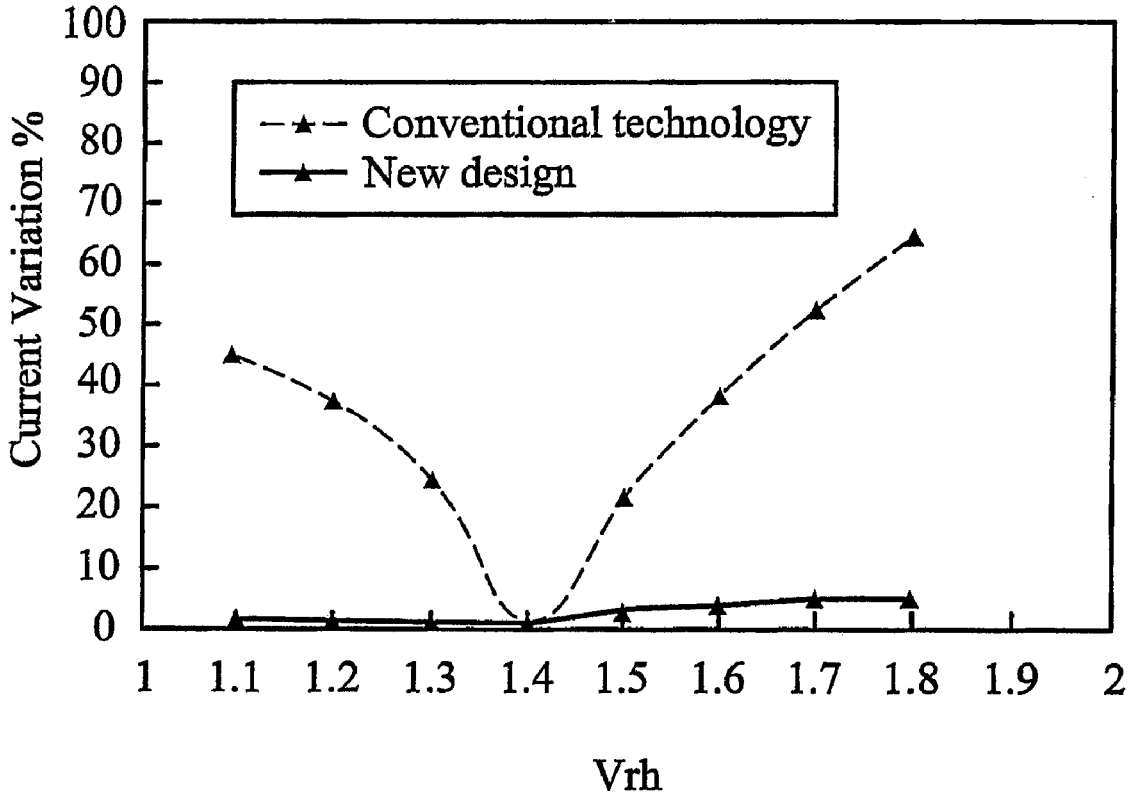
FIG. 4 is a diagram showing the percentage of a current variation with respect to a $V_{th}$ variation in a conventional circuit and that in a pixel driving circuit according to one embodiment of the present invention.

FIG. 4 shows a percentage of current variation with respect to $V_{th}$ variation for conventional technology and for the pixel driving circuit 200 according to the embodiment of the present invention. A threshold voltage $V_{th}$=1.4V is given as the standard. In the conventional technology, when the threshold voltage $V_{th}$ deviates from 1.4V, the current variation becomes significant. It is found that with the pixel driving circuit 200 according to the embodiment of the present invention, the current variation is negligible when compared with conventional technology.

Figure 7:
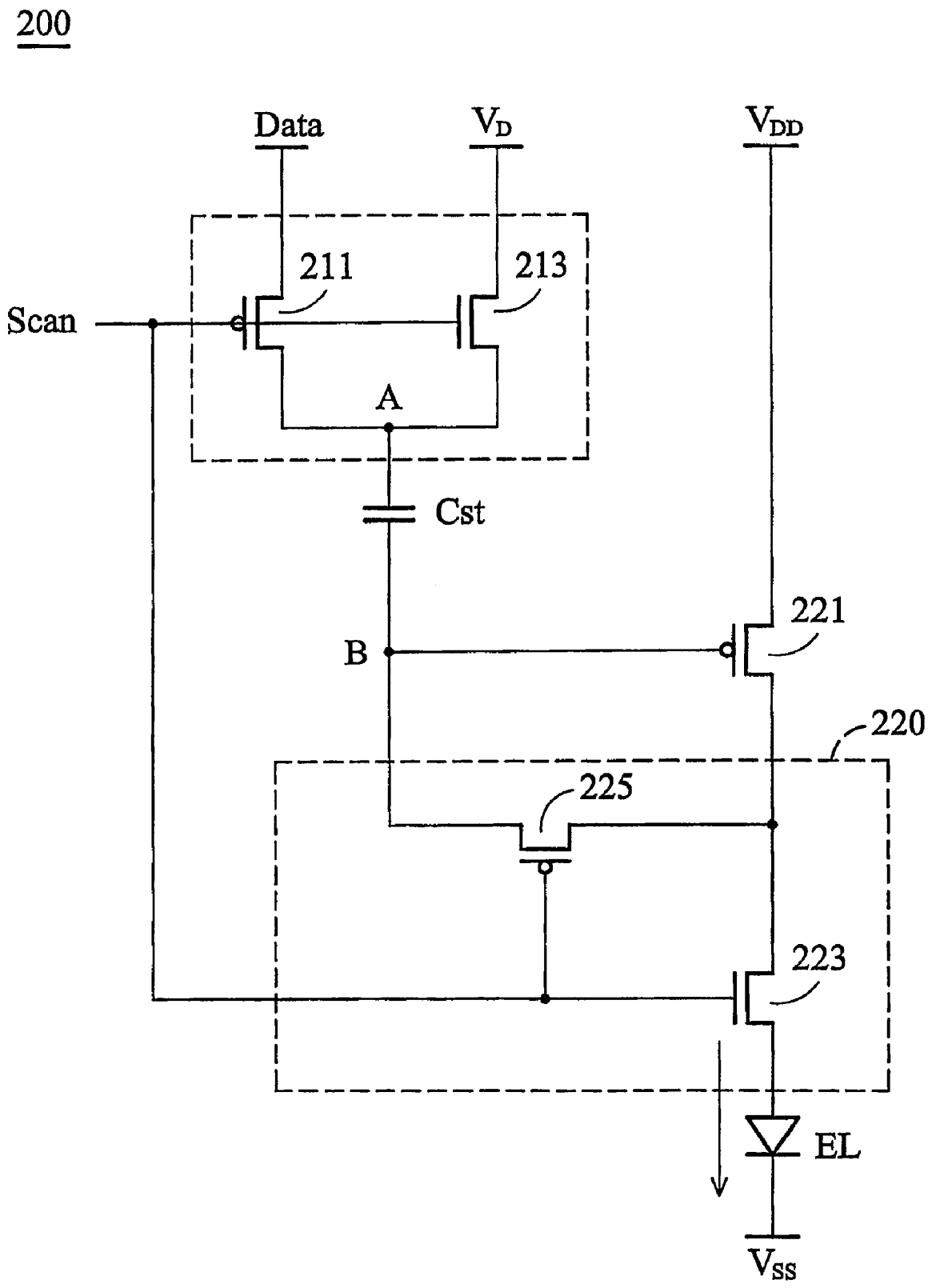
FIG. 7 is a circuit diagram showing a pixel driving circuit according to another embodiment of the present invention.
Figure 8:
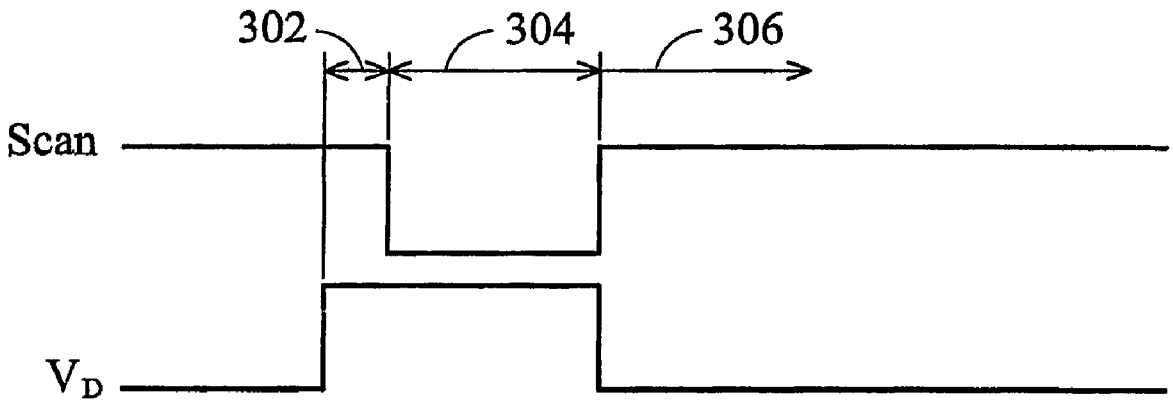
FIG. 8 is a timing diagram showing the timing of scan signals Scan, ScanX and a reference signal $V_D$ for the pixel driving circuit shown in FIG. 7.

FIG. 7 shows a second embodiment of the present invention which discloses a structure similar to the pixel driving circuit shown in FIG. 2, except that the first scan line Scan and the second scan line ScanX in FIG. 2 are tied together and controlled by the same signal Scan. FIG. 8 illustrates a timing diagram of a signal Scan of the scan lines and a variable reference signal $V_D$ for the pixel driving circuit 700 shown in FIG. 7.

Figure 11:
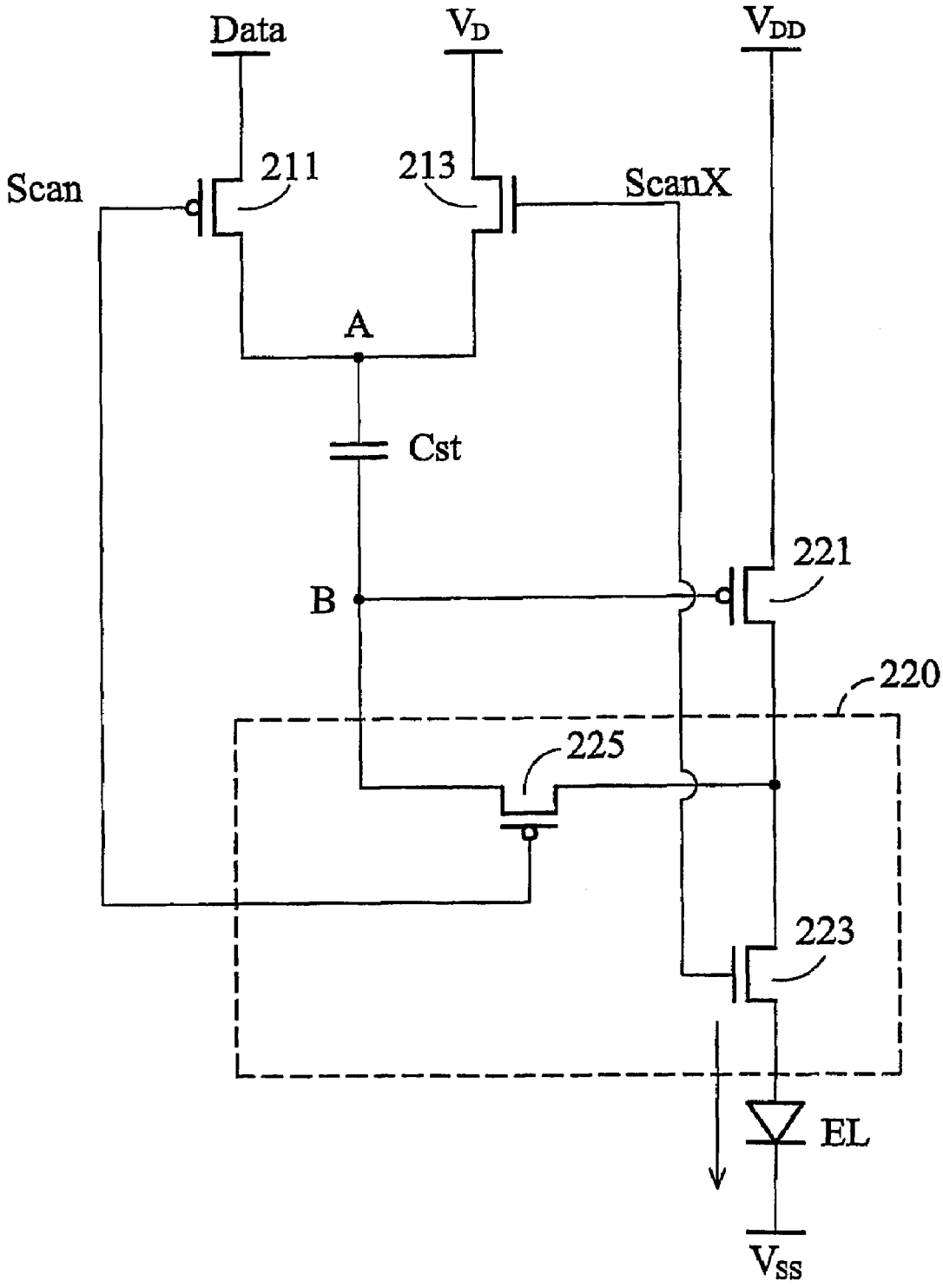
FIG. 11 is a circuit diagram showing a pixel driving circuit according to another embodiment of the present invention.
Figure 12:
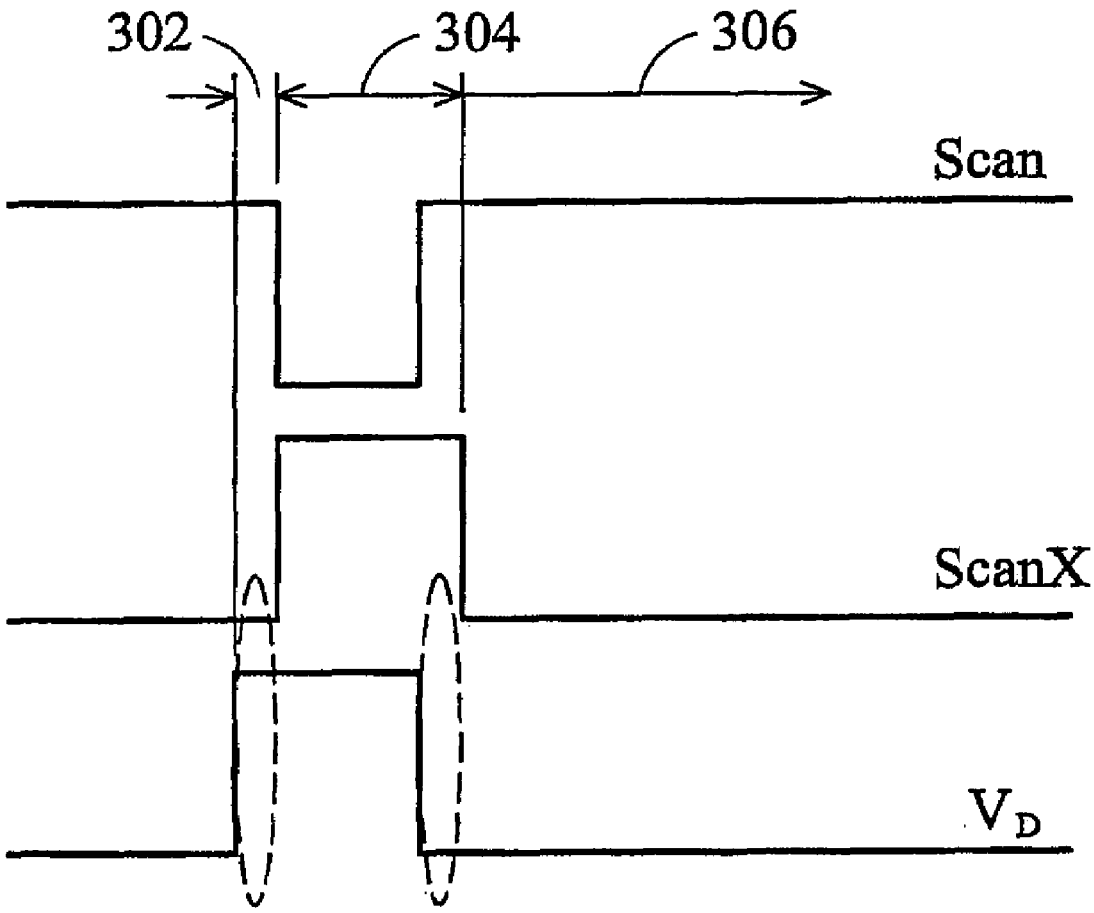
FIG. 12 is a timing diagram showing the timing of scan signals Scan, ScanX and a reference signal $V_D$ for the pixel driving circuit shown in FIG. 11.

FIG. 11 shows a third embodiment of the present invention which discloses a structure similar to the pixel driving circuit shown in FIG. 2 with the exception noted below. FIG. 12 is a timing diagram showing the timing of scan signals Scan, ScanX and a reference signal $V_D$ for the pixel driving circuit shown in FIG. 11. The difference between FIG. 2 and FIG. 11 is that the transistors controlled by the second scan line ScanX are of opposite type. Thus, the signal of the second scan line ScanX is also reversed, shown in FIG. 12, to make the pixel driving circuit shown in FIG. 11 work. In this embodiment, as shown in FIG. 12, also three modes are provided. Its operation is similar to the description in relation to the first embodiment and thus can be understood by skilled person without further elaboration needed here.

Figure 9:
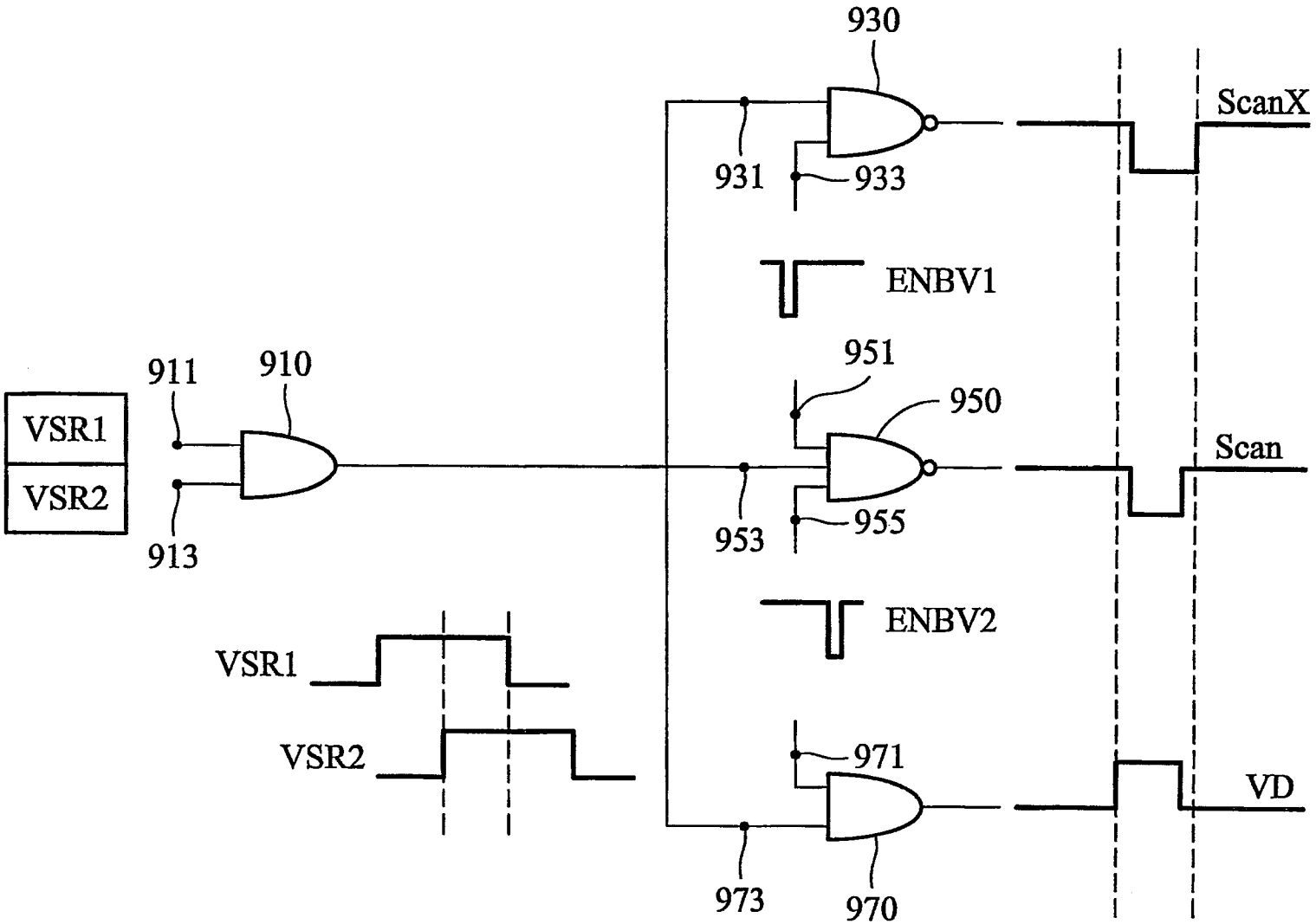
FIG. 9 is a logic diagram showing the structure of a reference signal generator according to one embodiment of the present invention as well as its behavior in each logic.

Herein, the present invention also provides embodiments of the reference signal generator. One embodiment of the reference signal generator comprises two NAND gates 930, 950 and two AND gates 910, 970, as shown in FIG. 9. Signals VSR 1 and VSR2 are sent to two inputs 911,913 of a first AND gate 910, wherein VSR1 and VSR2 stand for signals generated by vertical shift registers in a gate driver circuit. An output signal of the first AND gate 910 and a first enabling signal ENBV1 are respectively sent to a first and a second input 931,933 of a first NAND gate 930, thus generating a first scan signal ScanX. The output signal of the first AND gate 910 and enabling signals ENBV1, ENBV2 are sent to inputs 951, 953 and 955 of a second NAND gate 950. As a result, the second NAND gate 950 generates a second scan signal Scan.

The output signal of the first AND gate 910 and the second enabling signal ENBV2 are respectively sent to a first and a second input 971, 973 of a second AND gate 970, thus providing a reference signal VD.

Figure 10:
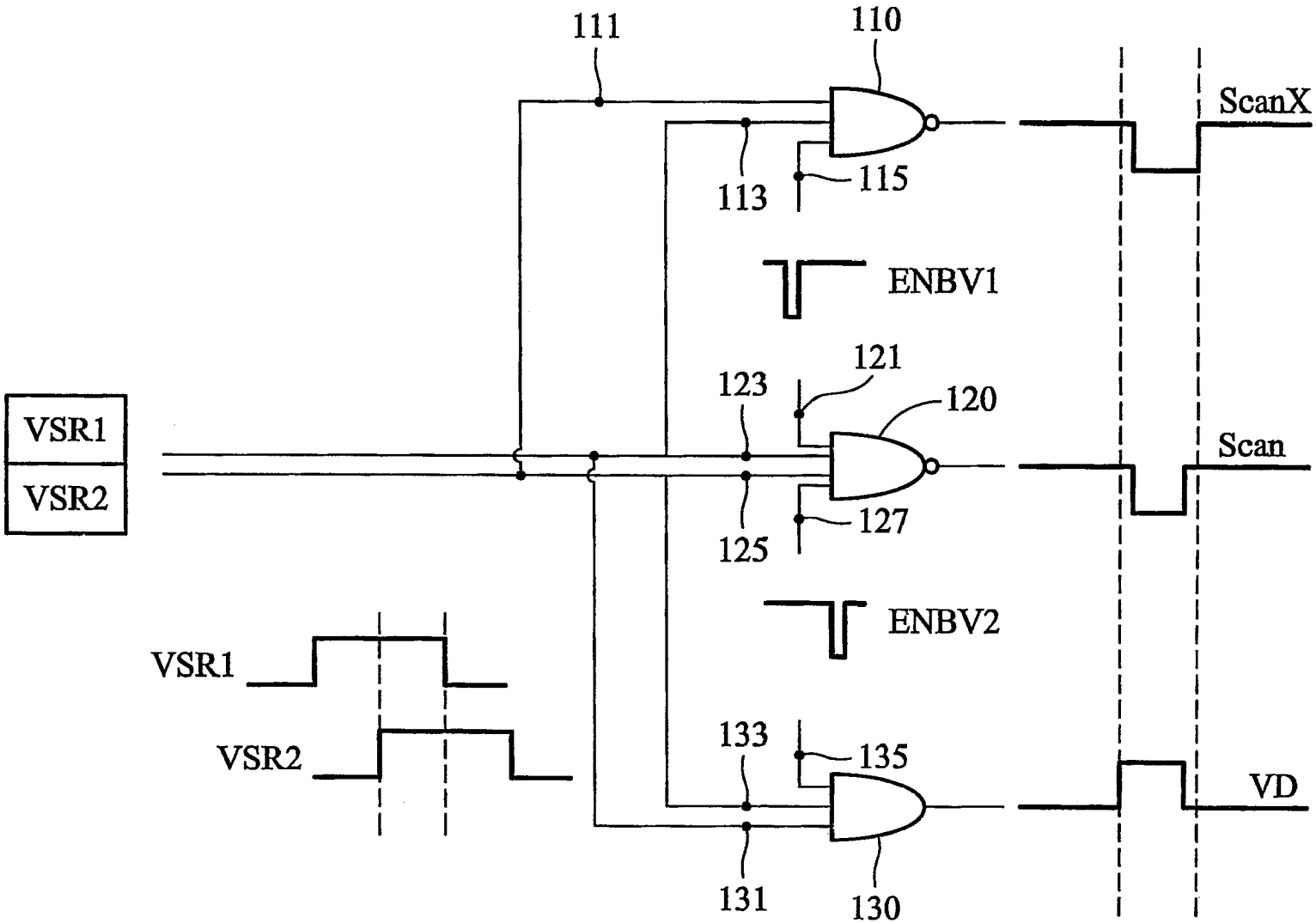
FIG. 10 is a logic diagram showing the structure of a reference signal generator according to another embodiment of the present invention as well as its behavior in each logic.

FIG. 10 shows another embodiment of the reference signal generator. This embodiment of the reference signal generator comprises two NAND gates 110,120 and one AND gate 130. Signals VSR1, VSR2 and ENBV1 are sent to inputs 111, 113 and 115 of a first NAND gate 110, thus providing a first scan signal ScanX. The signals VSR 1, VSR2, ENBV1 and ENBV2 are sent to inputs 121, 123, 125 and 127 of a second NAND gate 120. As a result, the second NAND gate 120 generates a second scan signal Scan. The signals VSR1, VSR2 and ENBV2 are sent to inputs 131, 133 and 135 of the AND gate 130, thus generating a signal VD.

Figure 6:
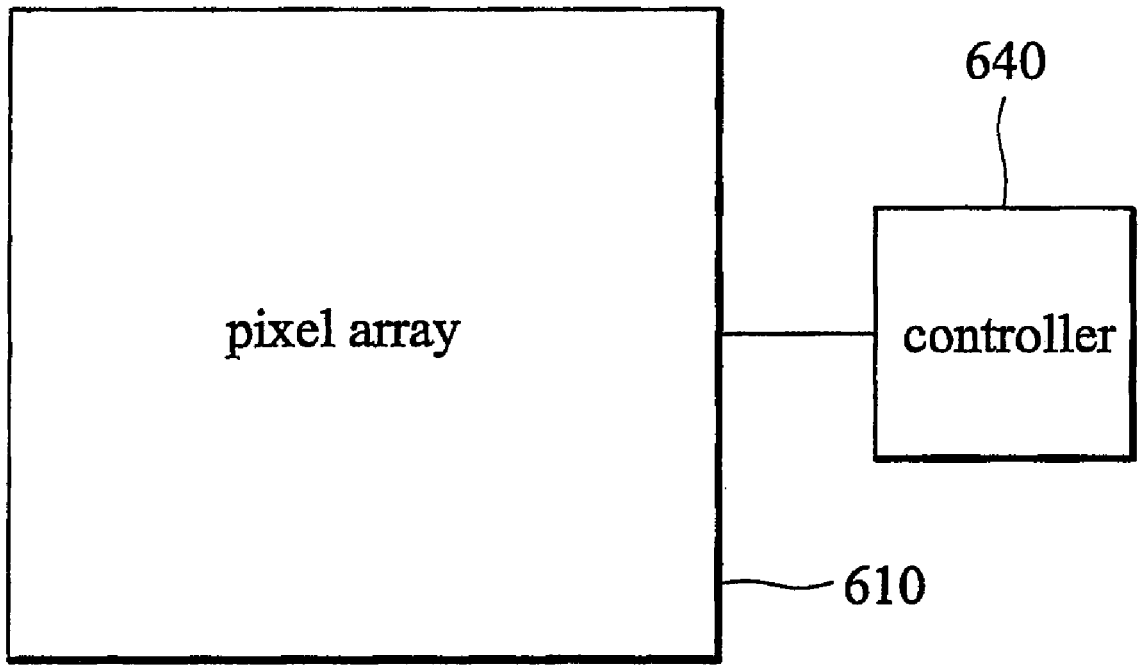
FIG. 6 is a block diagram showing the structure of a panel display according to one embodiment of the present invention.
Figure 13:
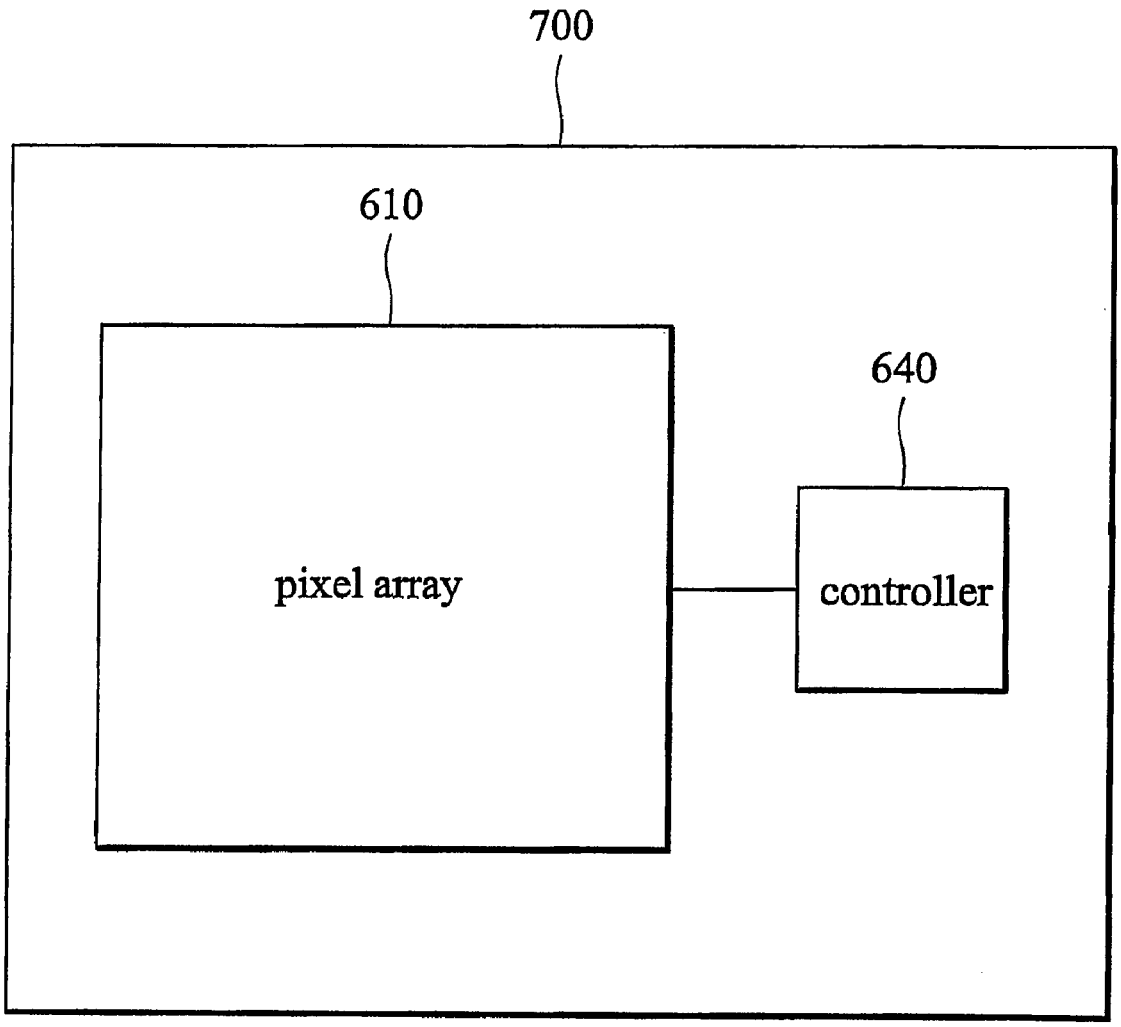
FIG. 13 is a schematic diagram of an electronic device comprising the disclosed panel display in FIG. 6.

Additionally, embodiments of the present invention also provide a panel display. As shown in FIG. 6, the panel display 600 comprises a pixel array 610 and a controller 640 . The pixel array 610 comprises a plurality of the pixel driving circuits shown in FIG. 2. The controller is operatively coupled to the pixel array and controls the operations of the storage capacitor, the transferring circuit, the driving element, and the switching circuit. In addition, embodiments of the invention also provide an electronic device comprising the disclosed panel display in FIG. 6, as shown in FIG. 13.

Figure 5:
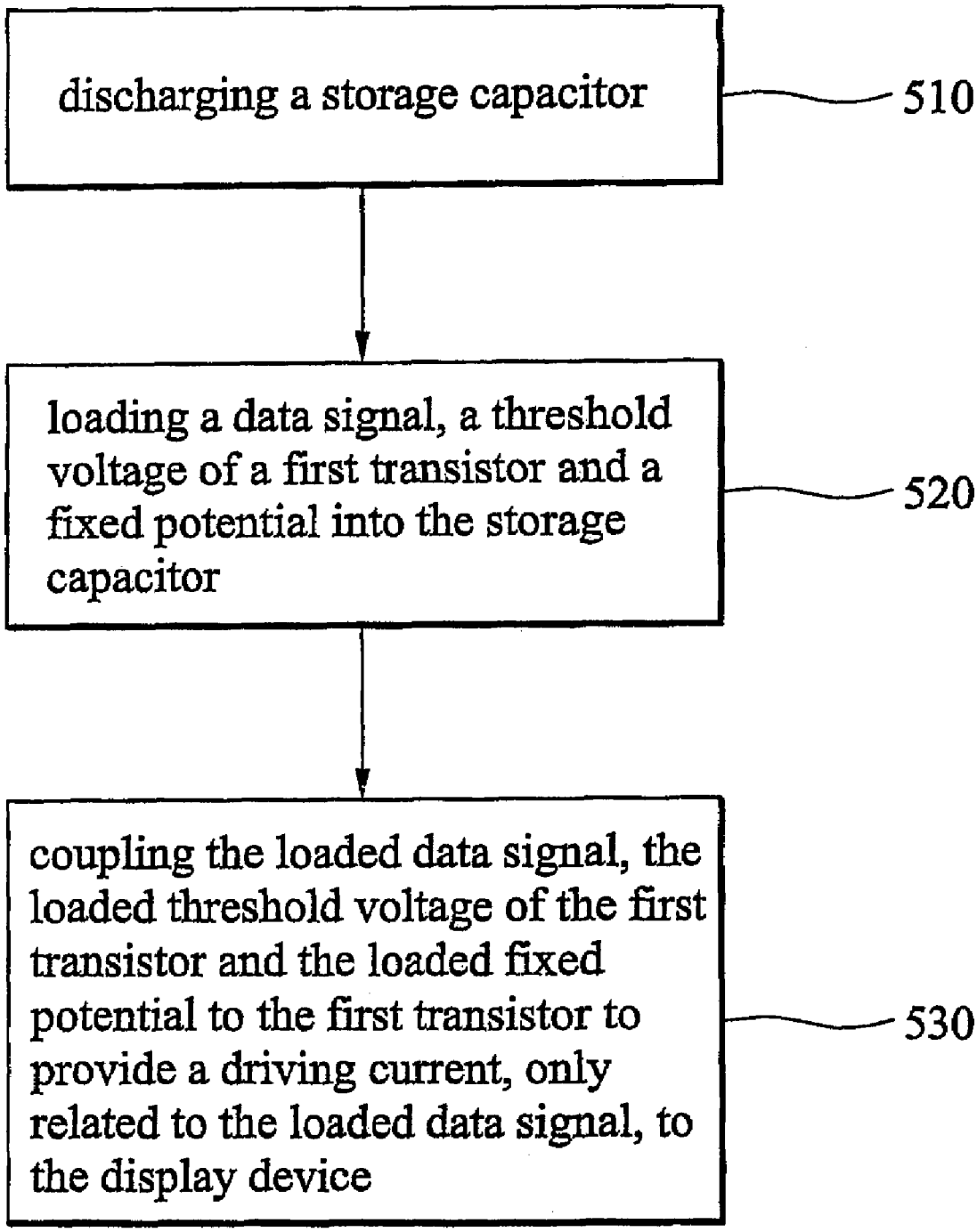
FIG. 5 is a flow chart illustrating a method for driving a display device in accordance with an embodiment of the present invention.

FIG. 5 illustrates an embodiment of a method for driving a display device according to the present invention. The driving method begins with discharging a storage capacitor during a discharge mode (step 510). The discharge mode occurs before a scan mode and, preferably, begins with a first switching of the reference signal and ends at the beginning of a scan mode. Thereafter, a data signal, a threshold voltage of a driving transistor 221 and a fixed potential are loaded into the storage capacitor during the scan mode(step 520). Subsequently, the loaded data signal, the loaded threshold voltage of the first transistor and the loaded fixed potential are coupled to the first transistor to provide a driving current that is independent of a threshold or fixed potential to the display device (step 530). More specifically, the display device is an electroluminescent device in accordance with one embodiment. The scan mode is substantially completed when a second switching of the reference signal occurs and the pixel driving circuit enters emission mode.

Preferably, the second switching of the reference signal occurs before the end of the scan mode such that improved display quality can be obtained. Additionally, the gate of the driving transistor is connected to the storage capacitor and the source of the driving transistor is connected to the fixed potential. More specifically, the fixed potential is a power supply potential.

Embodiments of the present invention provide a pixel driving circuit with threshold voltage compensation. Variations of threshold voltage, power supply voltage or both, are compensated and a driving current is $V_{th}(V_{dd})$-independent. Thus, the brightness of each pixel is $V_{th}(V_{dd})$-independent.

While the present invention has been described by way of example and in terms of several embodiments, it is to be understood that the present invention is not limited to the disclosed embodiments. To the contrary, it is intended to cover various modifications and (as would be apparent to those skilled in the art). Therefore, the scope of the appended claims should be accorded the broadest interpretation so as to encompass all such modifications.

What is claimed is:

1. A pixel driving circuit, comprising:

a storage capacitor having a first and second node;

a transferring circuit coupled to the first node of the storage capacitor, the transferring circuit transferring a data signal or a variable reference signal to the first node of the storage capacitor, wherein the variable reference signal is a pulsed reference signal;

a driving element having a first terminal coupled to a first fixed potential, a second terminal coupled to the second node of the storage capacitor, and a third terminal for outputting a driving current;

a switching circuit, coupled to the third terminal of the driving element and the second node of the storage capacitor, capable of making the driving element diode-connected in one time period and allowing the driving current to be output to a display element in another time period; and a reference signal generator coupled to the transferring circuit, wherein the reference signal generator comprises:

a first AND gate, with two inputs receiving signals from vertical shift registers, the first AND gate generating an output signal;

a first NAND gate, with a first input receiving the output signal from the first AND gate and a second input receiving a first enabling signal, the first NAND gate generating a first scan signal for a second scan line;

a second NAND gate, with three inputs receiving the output signal from the first AND gate, the first enabling signal, and a second enabling signal respectively, the second NAND gate generating a second scan signal for a first scan line; and a second AND gate, with a first input receiving the output signal from the first AND gate and a second input receiving the second enabling signal, the second AND gate generating a reference signal.

2. The pixel driving circuit as claimed in claim 1, wherein the driving element is a PMOS transistor.

3. The pixel driving circuit as claimed in claim 1, wherein the transferring circuit comprises:

a first transistor, having a first terminal receiving the data signal, a second terminal connected to a first scan line, and a third terminal coupled to the first node of the storage capacitor; and a second transistor, having a first terminal receiving the variable reference signal, a second terminal connected to a second scan line, and a third terminal coupled to the first node of the storage capacitor.

4. The pixel driving circuit as claimed in claim 3, wherein the first and second transistors are a PMOS and a NMOS transistor respectively.

5. The pixel driving circuit as claimed in claim 3, wherein the first and second transistors are PMOS transistors.

6. The pixel driving circuit as claimed in claim 3, wherein the first and second transistors are polysilicon thin film transistors.

7. The pixel driving circuit as claimed in claim 4, wherein the first and the second scan lines respectively have pulses in the same polarity.

8. The pixel driving circuit as claimed in claim 5, wherein the first and the second scan lines respectively have pulses in different polarities.

9. The pixel driving circuit as claimed in claim 7, wherein the second scan line has a pulse-over timing later than that of the first scan line.

10. The pixel driving circuit as claimed in claim 4, wherein the first and the second scan lines are tied together.

11. The pixel driving circuit as claimed in claim 1, wherein the switching circuit comprises:

a third transistor, having a first terminal connected to the display element, a second terminal connected to a second scan line, and a third terminal connected to a third terminal of the driving element; and a fourth transistor, having a first terminal coupled to the third terminals of the driving element and the third transistor, a second terminal coupled to the second node of the storage capacitor and the second terminal of the driving element, and a third terminal connected to a first scan line.

12. The pixel driving circuit as claimed in claim 11, wherein the third and fourth transistors are a NMOS and a PMOS transistor respectively.

13. The pixel driving circuit as claimed in claim 11, wherein the third and fourth transistors are PMOS transistors.

14. The pixel driving circuit as claimed in claim 11, wherein the third and fourth transistors are polysilicon thin film transistors.

15. The pixel driving circuit as claimed in claim 1, wherein the first fixed potential is a power supply potential.

16. The pixel driving circuit as claimed in claim 1, wherein the display device is an electroluminescent device.

17. A pixel driving circuit, comprising:

a storage capacitor having a first and second node;

a transferring circuit coupled to the first node of the storage capacitor, the transferring circuit transferring a data signal or a variable reference signal to the first node of the storage capacitor, wherein the variable reference signal is a pulsed reference signal;

a driving element having a first terminal coupled to a first fixed potential, a second terminal coupled to the second node of the storage capacitor, and a third terminal for outputting a driving current;

a switching circuit, coupled to the third terminal of the driving element and the second node of the storage capacitor, capable of making the driving element diode-connected in one time period and allowing the driving current to be output to a display element in another time period; and a reference signal generator coupled to the transferring circuit, wherein the reference signal generator comprises:

a first NAND gate, with two inputs receiving signals from vertical shift registers and a third input receiving a first enabling signal, the first NAND gate generating a first scan signal for the second scan line;

a second NAND gate, with two inputs receiving signals from vertical shift registers and two inputs receiving the first enabling signal and a second enabling signal respectively, the second NAND gate generating a second scan signal for the first scan line; and a AND gate, with two inputs receiving signals from vertical shift registers and a third input receiving a second enabling signal, the AND gate generating a reference signal.

18. A method for driving a display element with a driving element and a storage capacitor, the method comprising the steps of:

discharging the storage capacitor through a switchable circuit by applying a reference signal thereto, wherein the reference signal is a pulsed reference signal generated by a reference signal generator that comprises:

a first AND gate, with two inputs receiving signals from vertical shift registers, the first AND gate generating an output signal;

a first NAND gate, with a first input receiving the output signal from the first AND gate and a second input receiving a first enabling signal, the first NAND gate generating a first scan signal for a second scan line;

a second NAND gate, with three inputs receiving the output signal from the first AND gate, the first enabling signal, and a second enabling signal respectively, the second NAND gate generating a second scan signal for a first scan line; and a second AND gate, with a first input receiving the output signal from the first AND gate and a second input receiving the second enabling signal, the second AND gate generating a reference signal;

loading a data signal and a threshold voltage of the driving element into the storage capacitor; and coupling the loaded data signal and the loaded threshold voltage into the driving element to provide a threshold-independent driving current to the display element.

19. The method as claimed in claim 18, wherein:

in the loading step, a fixed supply potential, along with the data signal and the threshold voltage of the first transistor, is also loaded into the storage capacitor; and in the coupling step, the loaded fixed supply potential, along with the loaded data signal and the loaded threshold voltage, is also coupled to the driving element.

20. The method as claimed in claim 19, wherein the step of discharging the storage capacitor begins at a timing when the reference signal is applied to the storage capacitor with a high level before the loading step.

21. The method as claimed in claim 19, wherein the step of loading begins with a scan mode at a timing that an active scan line is applied to a switch element to allow the data signal being applied to the storage capacitor.

22. The method as claimed in claim 18, wherein step of coupling the loaded data signal, the loaded threshold voltage and the loaded fixed potential to the driving element begins with the scan mode at a timing after the reference signal is applied to the storage capacitor with a low level.

23. The method as claimed in claim 21, wherein the reference signal changes its state before it is allowed being applied to the storage capacitor through a switch element.

24. The method as claimed in claim 18, wherein the driving element has a gate connected to the storage capacitor and a source connected to the fixed potential.

25. The method as claimed in claim 18, wherein the fixed potential is a power supply potential.

26. The method as claimed in claim 18, wherein the display device is an electroluminescent device.

27. A display panel, comprising:

a pixel array comprising a plurality of pixel driving circuits as claimed in claim 1; and a controller operatively coupled to the pixel array, controlling the operations of the storage capacitor, the transferring circuit, the driving element, and the switching circuit.

28. An electronic device comprising the display panel as claimed in claim 27.

29. The pixel driving circuit as claimed in claim 8, wherein the second scan line has a pulse-over timing later than that of the first scan line.

30. The method as claimed in claim 22, wherein the reference signal changes its state before it is allowed being applied to the storage capacitor through a switch element.

* * * * *